US011404232B1

(12) United States Patent
Liao

(10) Patent No.: US 11,404,232 B1
(45) Date of Patent: Aug. 2, 2022

(54) ELECTROMAGNETIC RELAY CAPABLE OF EXTERNALLY AND MANUALLY CONTROLLING, TURNING ON, AND SHUTTING OFF ELECTRIC POWER

(71) Applicant: SONG CHUAN PRECISION CO., LTD., New Taipei (TW)

(72) Inventor: Po-Jen Liao, New Taipei (TW)

(73) Assignee: SONG CHUAN PRECISION CO., LTD., New Taipei (TW)

( * ) Notice: Subject to any disclaimer, the term of this patent is extended or adjusted under 35 U.S.C. 154(b) by 0 days.

(21) Appl. No.: 17/204,895

(22) Filed: Mar. 17, 2021

(51) Int. Cl.
*H01H 50/64* (2006.01)
*H01H 51/29* (2006.01)

(52) U.S. Cl.
CPC ..... *H01H 50/648* (2013.01); *H01H 50/641* (2013.01); *H01H 51/29* (2013.01)

(58) Field of Classification Search
CPC ..... H01H 50/648; H01H 50/641
USPC ..... 335/129
See application file for complete search history.

(56) References Cited

U.S. PATENT DOCUMENTS 6,940,375 B2 * 9/2005 Sanada ..... H01H 50/56 335/86
10,811,205 B2 * 10/2020 Hayashida ..... H01H 50/641
11,257,647 B1 * 2/2022 Liao ..... H01H 50/54
2005/0242907 A1 * 11/2005 Minowa ..... H01H 50/443 335/129
2009/0033446 A1 * 2/2009 Gruner ..... H01H 51/2281 335/129

* cited by examiner

*Primary Examiner* — Alexander Talpalatski
(74) *Attorney, Agent, or Firm* — Fei-hung Yang

(57) ABSTRACT

An electromagnetic relay capable of externally and manually controlling, turning on, and shutting off electric power includes casing, push-pull rod and relay module. The casing has top cover, where slideway is formed, and an end of the slideway has bump. The push-pull rod is installed to the slideway and has an end formed into hook portion and passed into the casing. An open slot, which has fitting hole and sliding hole, is formed on the push-pull rod. The relay module is installed at the chassis and has elastic contact plate assembly and lever, and an end of the lever is engaged with the hook portion. After the fitting hole is sheathed on the bump, the sliding hole is moved relative to the bump, so that the hook portion drives the lever to push the elastic contact plate assembly to define electrical connection or disconnection state according to different requirements.

20 Claims, 6 Drawing Sheets

ELECTROMAGNETIC RELAY CAPABLE OF EXTERNALLY AND MANUALLY CONTROLLING, TURNING ON, AND SHUTTING OFF ELECTRIC POWER

BACKGROUND

Technical Field

The present invention relates to the technical field of relays. More particularly, the present invention relates to an electromagnetic relay capable of externally and manually controlling, turning on, and shutting off electric power based on a novel structural design of a casing, a push-pull rod, and a lever to meet testing and other requirements.

Description of Related Art

Relay, also known as electric relay, is an electronic control component widely used in control circuits. In short, a relay is an electronic switch that controls a large current by a small current, and it can be divided into various types such as optical relay, electromagnetic relay, thermal, relay etc. according to its operating principle.

For example, the electromagnetic relay is mainly divided into DC relay and AC relay according to the nature of input currents, and the operating principles of both DC and AC relays are substantially the same, except the design of iron cores. In general, the electromagnetic relay includes an electromagnetic coil, a movable contact and a fixed contact, and the fixed contact is externally coupled to a control circuit, wherein after the electromagnetic coil is electrically conducted, the movable contact will be displaced due to the electromagnetism of the electromagnetic coil, so as to achieve the effects of turning on or shutting off the electric power. However, the conventional electromagnetic relay controls, turns on, or shuts off the whole electric power by a change of the magnetic field of a coil installed in the relay, but in some special applications such as testing, replacement, or other operations, the circuit conduction state cannot be known from the outside of the electromagnetic relay and there is no way to control the electromagnetic relay direction in order to turn on or shut off the electric power. Obviously, the conventional electromagnetic relay is quite inconvenient, and may be dangerous when it is touched by mistake during operation.

In view of the aforementioned drawbacks of the conventional electromagnetic relay, the inventor of the present invention based on years of experience in the related industry to conduct extensive research and experiment, and finally developed and provided an electromagnetic relay capable of externally and manually controlling, turning on, and shutting off electric power to improve the convenience of use.

SUMMARY

Therefore, it is a primary objective of the present invention to provide an electromagnetic relay capable of externally and manually controlling, turning on, and shutting off electric power, so that operators can control, turn on and shut off the electric power of the electromagnetic relay directly from the outside of the relay to meet various application requirements and improve the convenience of operation.

To achieve the aforementioned and other objectives, the present invention discloses an electromagnetic relay capable of externally and manually controlling, turning on, and shutting off electric power, and the electromagnetic relay comprises: a casing, having a chassis and a top cover, wherein a slideway is concavely formed on the top cover, and an end of the slideway is communicated with an inner side of the top cover, and the other end of the slideway has a bump, and the cross-section of the bump is T-shaped;

a push-pull rod, installed to the slideway and movable relative to the top cover, and having an end formed into a force applying portion and the other end formed into a hook portion and passed into the casing, and an open slot being concavely formed on a main body of the push-pull rod, and a fitting hole and a sliding hole being formed at the bottom of the open slot and coupled to each other, and the sliding hole being in a regular rectangular shape, and the fitting hole having a size corresponding to the size of the bump, and the sliding hole having a width smaller than that of the fitting hole; and a relay module, installed in the chassis, and having at least one elastic contact plate assembly and a lever facing the top cover, and the elastic contact plate assembly having at least one fixed contact plate and at least one movable contact plate, and the lever having an end directly or indirectly pushing the movable contact plate and the fixed contact plate to be contacted with or disconnected from each other and the other end engaged securely with the hook portion; wherein after the fitting hole of the push-pull rod is sheathed on the bump, the sliding hole can be moved relative to the bump to drive the hook portion to displace in the casing, and after a force is exerted onto the force applying portion, the sliding hole can be moved relative to the position of the bump, so that the hook portion drives the lever to push the elastic contact plate assembly to form an electrical connection or disconnection state. Through the cooperative operation of the push-pull rod and the slideway and the lever, the effect of externally and directly controlling, turning on, or shutting off the electric power by the relay can be achieved, so that operators can control the state of the relay quickly to meet various different requirements without the need of adjusting a complicated process, and to improve the convenience of maintenance and assembling.

Preferably, the fitting hole is either in a circular shape or in a square shape to facilitate the installation of the bump; and the force applying portion is a T-shaped workpiece to facilitate the push-pull operation.

Preferably, the push-pull rod has a plurality of through-hole portion, in order to lower the cost of components, while providing a slight deformation space during operation to facilitate the push-pull operation.

Preferably, the top cover has a visual opening formed thereon, configured to be corresponsive to a moving position of the lever, and provided for visually determining an electrical connection or disconnection state of the elastic contact plate assembly to improve the convenience of control.

Preferably, the electromagnetic relay further comprises: a rotating bridge, having a main body, and a first rotating plate and a second rotating plate extending from both sides of the main body respectively; wherein if both of the quantity of the fixed contact plates and the quantity the movable contact plates are two, they are defined as a first fixed contact plate and a first movable contact plate, and a second fixed contact plate and a second movable contact plate; an end of the lever has a first engaging slot and a second engaging slot, and the first engaging slot and the first movable contact plate are engaged and coupled to each other securely, and the second engaging slot and the first rotating plate are engaged and coupled to each other securely, and the second rotating plate is directly or indirectly engaged and coupled to the second movable contact plate; after a force is exerted onto the lever, the contact or disconnection state of the first movable contact plate with the first fixed contact plate and the contact or disconnection state of the second movable contact plate with the second fixed contact plate can be achieved synchronously, so that the relay can be turned on or shut off more stably and smoothly.

Preferably, the second rotating plate of the rotating bridge is engaged securely to an end of the extension arm an end, and the other end of the extension arm is engaged securely to the second movable contact plate, and thus the structure of the extension arm can drive the second movable contact plate to improve the stability of operation. Further, the main body of the rotating bridge has a magnetic property for driving the operation of the rotating bridge by a magnetic control.

In summation of the description above, the electromagnetic relay capable of externally and manually controlling, turning on and shutting off the electric power in accordance with the present invention is surely a novel product that can meet various application requirements. With the push-pull rod installed to the outer side of the electromagnetic relay and the configuration of the slideway on the casing and the lever of the relay module, the effect of externally and directly controlling, turning on and shutting off the electric power can be achieved to improve the convenience of application significantly. Besides the novel structural design of the electromagnetic relay of the present invention, the structures of the push-pull rod, the slideway and the lever are designed according to various considerations, and the structural design of the elastic contact plate assembly capable of controlling the interior from the exterior in the limited space of the electromagnetic relay. To further facilitate the push-pull control, the present invention also provides detailed structural characteristics for the fitting hole and the push-pull rod. To recognize the ON/OFF state of the relay quickly, the visual opening is added to the top cover. These technical characteristics of the present invention further improve over the prior art.

DESCRIPTION OF THE EMBODIMENTS

Figure 1A:
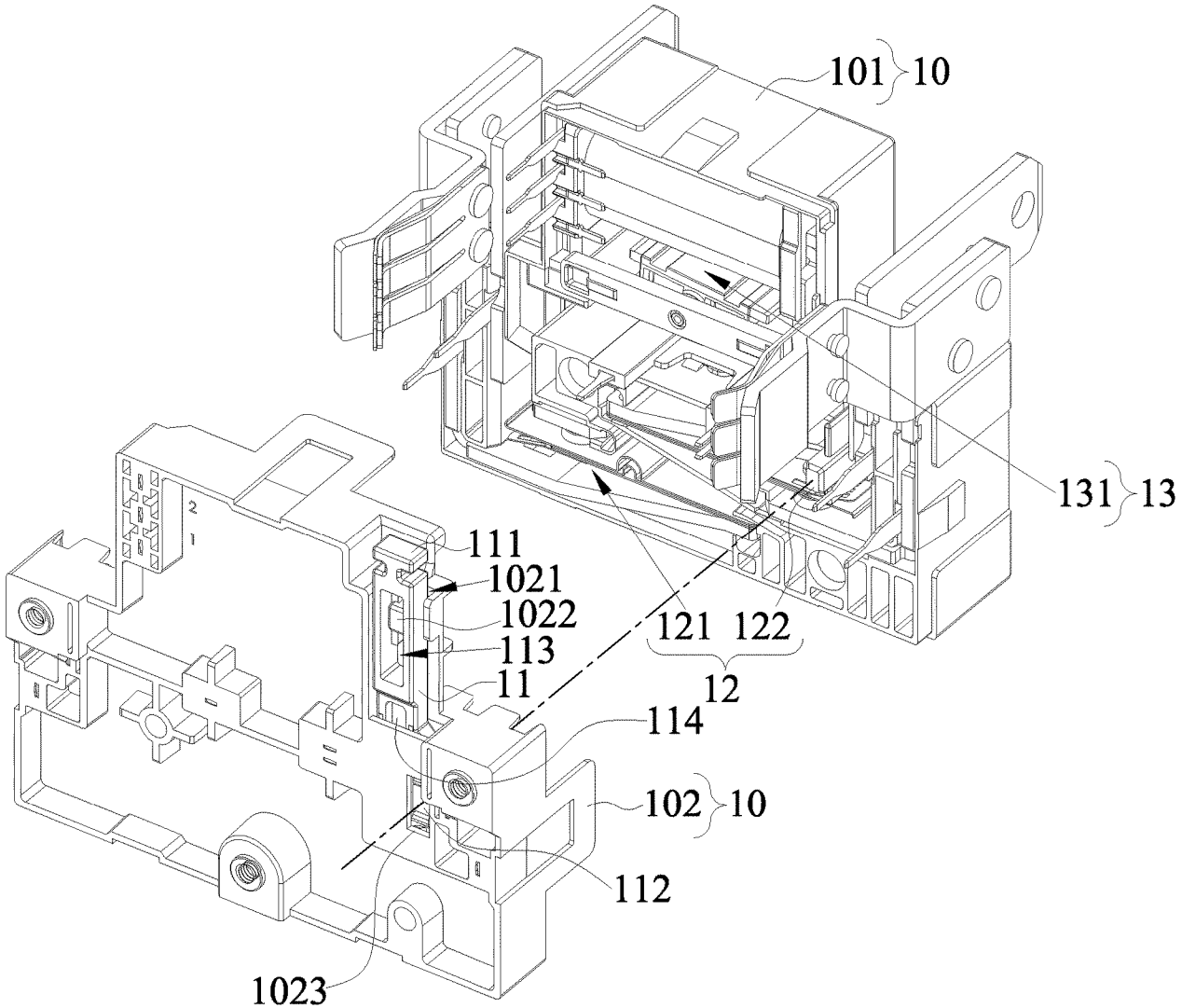
FIG. 1A is an exploded view of an electromagnetic relay in accordance with an embodiment of this invention.
Figure 1B:
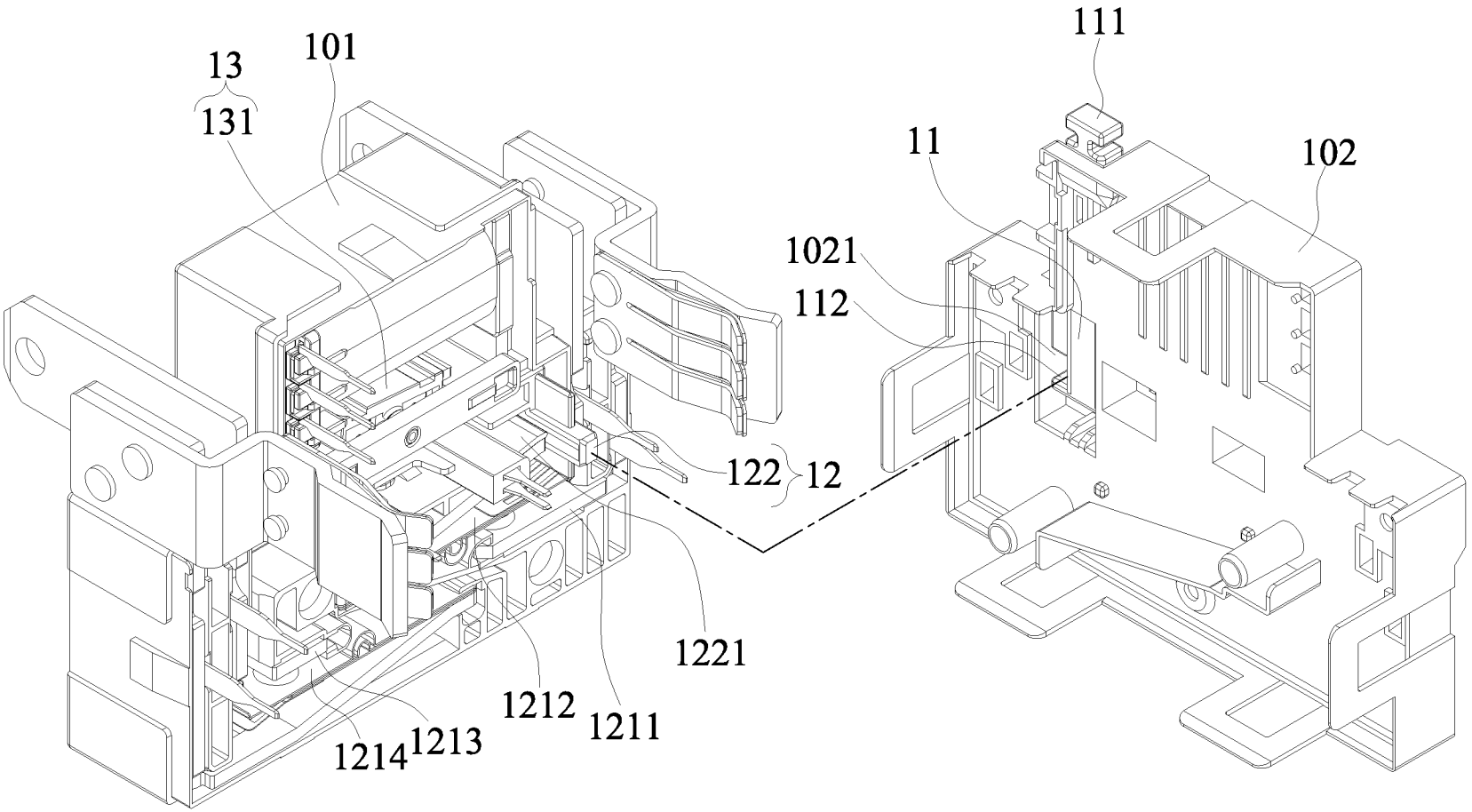
FIG. 1B is another exploded view of an electromagnetic relay in accordance with an embodiment of this invention, viewing from another angle.
Figure 2A:
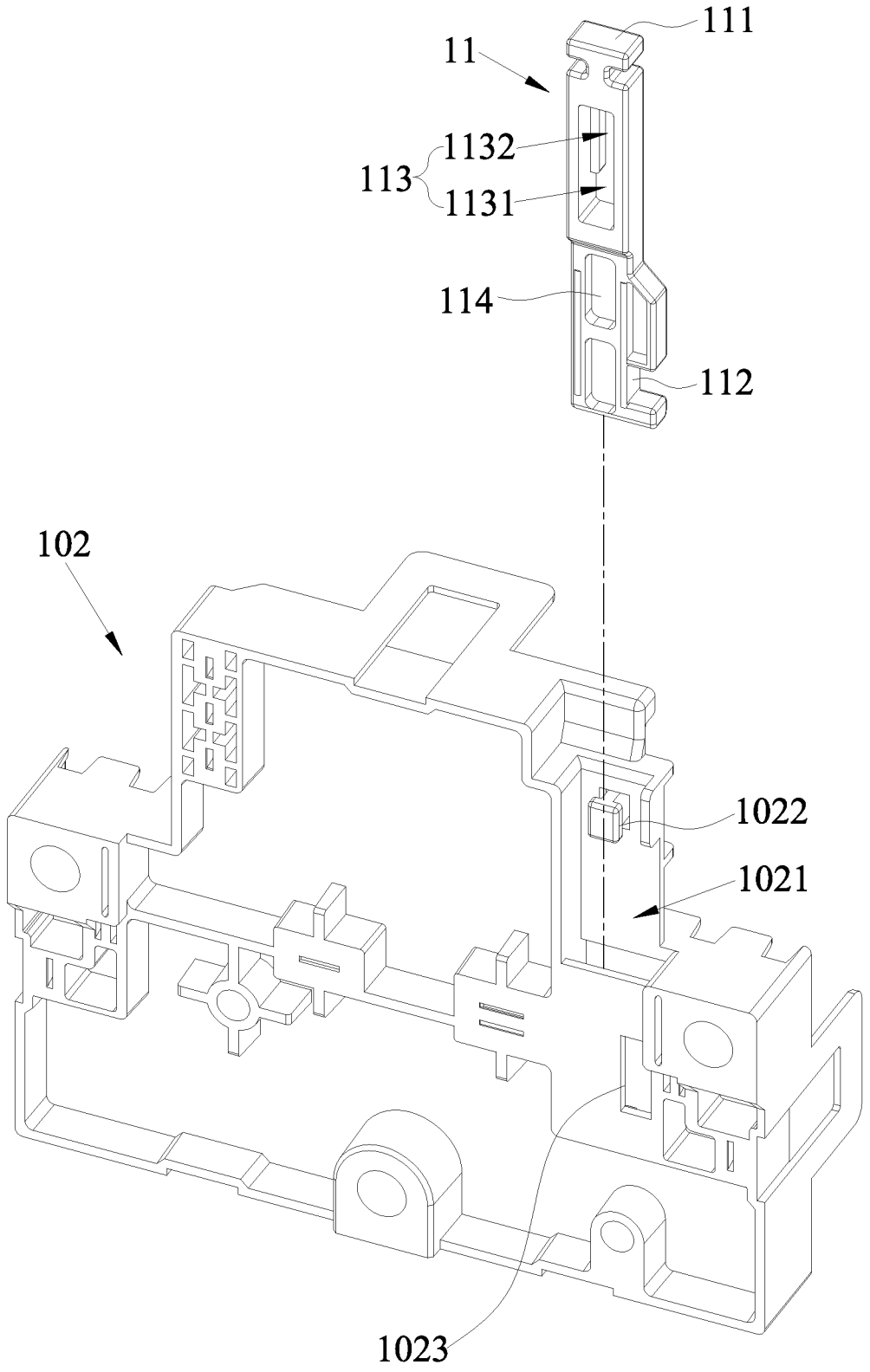
FIG. 2A is an exploded view showing a top cover and a push-pull rod in accordance with an embodiment of the present invention.
Figure 2B:
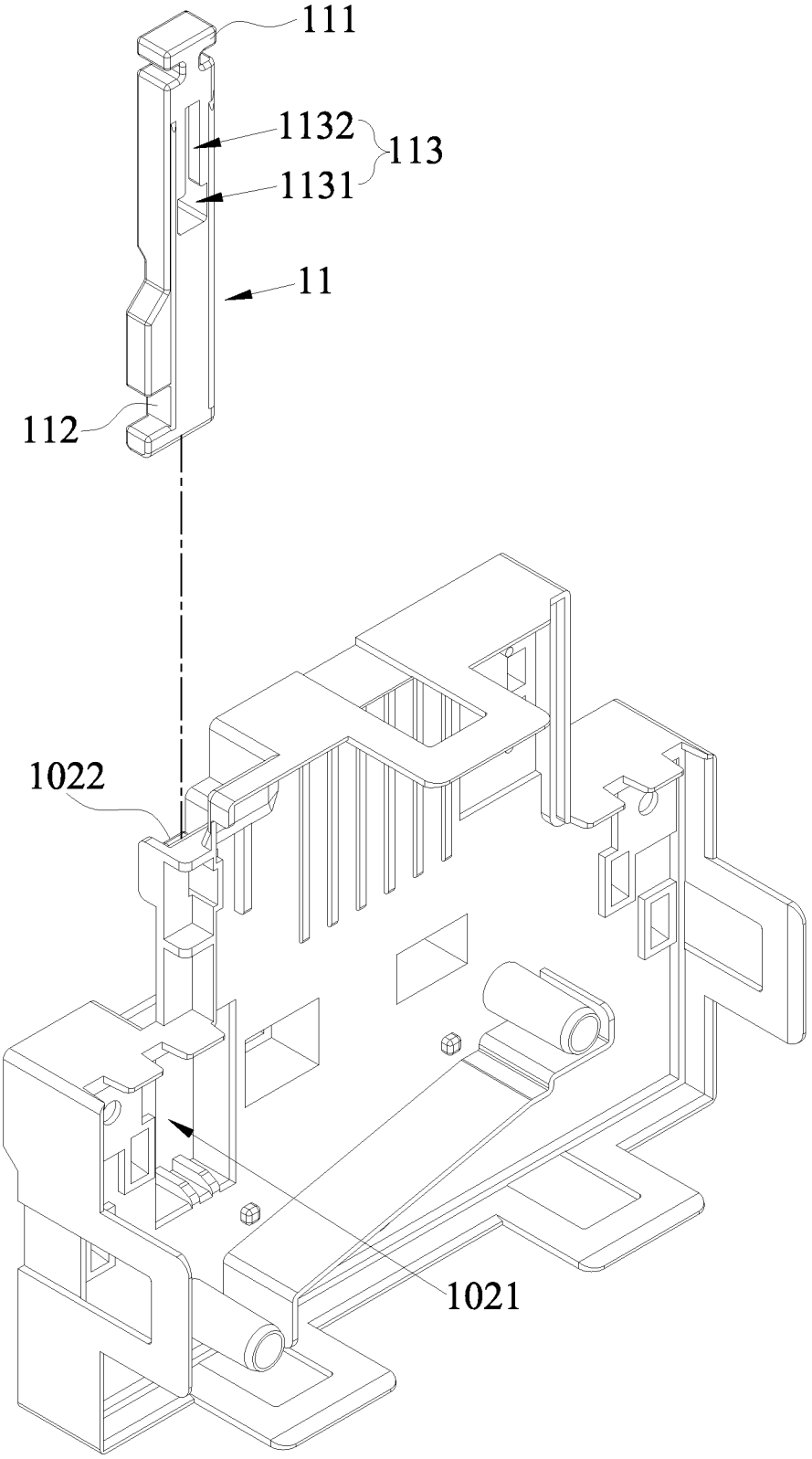
FIG. 2B is another exploded view showing a top cover and a push-pull rod in accordance with an embodiment of the present invention, viewing from another angle.

The accompanying drawings are included to provide a further understanding of the disclosure, and are incorporated in and constitute a part of this specification. The drawings illustrate embodiments of the disclosure and, together with the description, serve to explain the principles of the disclosure.

With reference to FIGS. 1A to 4 for two exploded views of an electromagnetic relay, two exploded views showing a top cover and a push-pull rod, and two schematic views showing the applications of the electromagnetic relay in accordance with an embodiment of the present invention respectively, the electromagnetic relay capable of externally and manually controlling, turning on, and shutting off electric power 1 comprises a casing 10, a push-pull rod 11 and a relay module 12, and the casing 10 has a chassis 101 and a top cover 102, wherein a slideway 1021 is concavely formed on the top cover 102, and an end of the slideway 1021 is communicated with an inner side of the top cover 102, and the other end of the slideway 1021 has a bump 1022, and the cross-section of the bump 1022 is T-shaped, which is a downwardly tapered structure.

The push-pull rod 11 is installed to the slideway 1021 and movable relative to the top cover 102, and an end of the push-pull rod 11 is formed into a force applying portion 111, and the other end of the push-pull rod 11 is formed into a hook portion 112 and passed into the casing 10, and an open slot 113 is concavely formed on a main body of the push-pull rod 11, and a fitting hole 1131 and a sliding hole 1132 are formed on the bottom of the open slot 113 and coupled to each other, and the sliding hole 1132 is in a regular rectangular shape, and the fitting hole 1131 has a size corresponding to the size of the bump 1022, and the sliding hole 1132 has a width smaller than that of the fitting hole 1131 to facilitate the installation of the bump 1022 and the movement of the push-pull rod 11.

The relay module 12 is installed in the chassis 101, and has at least one elastic contact plate assembly 121 and a lever 122 facing the top cover 102, and the elastic contact plate assembly 121 has at least one fixed contact plate and at least one movable contact plate, and an end of the lever 122 can directly or indirectly push the movable contact plate and the fixed contact plate to be contacted with or disconnected from each other, and the other end of the lever 122 and the hook portion 112 are engaged securely with each other, wherein after the fitting hole 1131 of the push-pull rod 11 is sheathed on the bump 1022, the sliding hole 1132 can be moved relative to the bump 1022 and drives the hook portion 112 to displace in the casing 10. When a force is exerted onto the force applying portion 111, the sliding hole 1132 can be moved relative to the position of the bump 1022, so that the hook portion 112 drives the lever 122 to push the elastic contact plate assembly 121 to form an electrical connection or disconnection state. The structures of the push-pull rod 11 and the slideway 1021 are provided for achieving the effect of moving the push-pull rod 11 from the outside, so that the hook portion 112 of the push-pull rod 11 can drive the lever 122 to move the lever 122 and drive the movable contact plate and the fixed contact plate to be contacted with or disconnected from each other, so as to achieve the effect of externally and directly controlling the electrical state of the electromagnetic relay 1. When it is necessary to perform an operation such as making a change or replacement, the push-pull rod 11 is provided for controlling and ensuring the electromagnetic relay 1 to be set to the power-off state to facilitate the subsequent operation.

Further, the fitting hole 1131 is either in a circular shape or a square shape to facilitate the installation of the bump 1022. In this embodiment, the fitting hole 1131 is in the square shape. To better control the push-pull rod 11, the force applying portion 111 is designed to be a T-shaped workpiece, so that operators can have a good grip to apply force for pushing or pulling.

Further, the push-pull rod 11 has a plurality of through-hole portions 114 to achieve the effects of lowering the component cost, reducing the friction with the slideway 1021 during operation, and facilitating the pushing and pulling operations. In this embodiment, the push-pull rod 11 has three through-hole portions 114.

To allow the operators to recognize the electrical state of the electromagnetic relay 1 quickly, the top cover 102 preferably has a visual opening 1023 formed thereon, configured to be corresponsive to the moving position of the lever 122, and provided for visually determining the electrical connection or disconnection state of the elastic contact plate assembly 121. In this way, we can quickly determine whether or not the electromagnetic relay 1 is electrically conducted through the visual opening 1023 during application and then proceed to the next step of the operation procedure, so as to improve the convenience of use. Further, a label can be marked at a position of the top cover 102 which is corresponsive to the visual opening 1023 to indicate the electrical ON/OFF state of the electromagnetic relay 1.

In an implementation mode of a preferred embodiment of the present invention, the electromagnetic relay 1 further comprises a rotating bridge 13, and the rotating bridge 13 has a main body 131, and a first rotating plate 1311 and a second rotating plate 1312 extending from both sides of the main body 131 respectively. Preferably, the main body 131 of the rotating bridge 13 has a magnetic property, so that the rotating bridge 13 can be driven to operate by the magnetic control. Wherein, when the quantity of the fixed contact plates and the quantity of the movable contact plates are two, they are defined as a first fixed contact plate 1211 and a first movable contact plate 1212, and a second fixed contact plate 1213 and a second movable contact plate 1214; an end of the lever 122 has a first engaging slot 1221 and a second engaging slot 1222, and the first engaging slot 1221 and the first movable contact plate 1212 are engaged and coupled securely with each other, and the second engaging slot 1222 and the first rotating plate 1311 are engaged and coupled securely with each other, and the second rotating plate 1312 is directly or indirectly engaged and coupled to the second movable contact plate 1214; after a force is exerted on the lever 122, the contact or disconnection state of the first movable contact plate 1212 and the first fixed contact plate 1211 and the contact or disconnection state of the second movable contact plate 1214 and the second fixed contact plate 1213 can be achieved synchronously. In this implementation, the relay module 12 has the corresponding fixed contact plate and movable contact plate, and the first movable contact plate 1212 and the second movable contact plate 1214 can be controlled and moved relative to the first fixed contact plate 1211 and the second fixed contact plate 1213 by the first rotating plate 1311 and the second rotating plate 1312 of the rotating bridge 13, and the second rotating plate 1312 of the rotating bridge 13 can be directly or indirectly engaged and coupled to the second movable contact plate 1214. In this embodiment, the second rotating plate 1312 of the rotating bridge 13 is engaged securely to an end of an extension arm 14, and the other end of the extension arm 14 is engaged securely to the second movable contact plate 1214, so that the second rotating plate 1312 of the rotating bridge 13 can be engaged and coupled securely to the second movable contact plate 1214 through the extension arm 14 to improve the stability of the operation of the second movable contact plate 1214.

Figure 3:
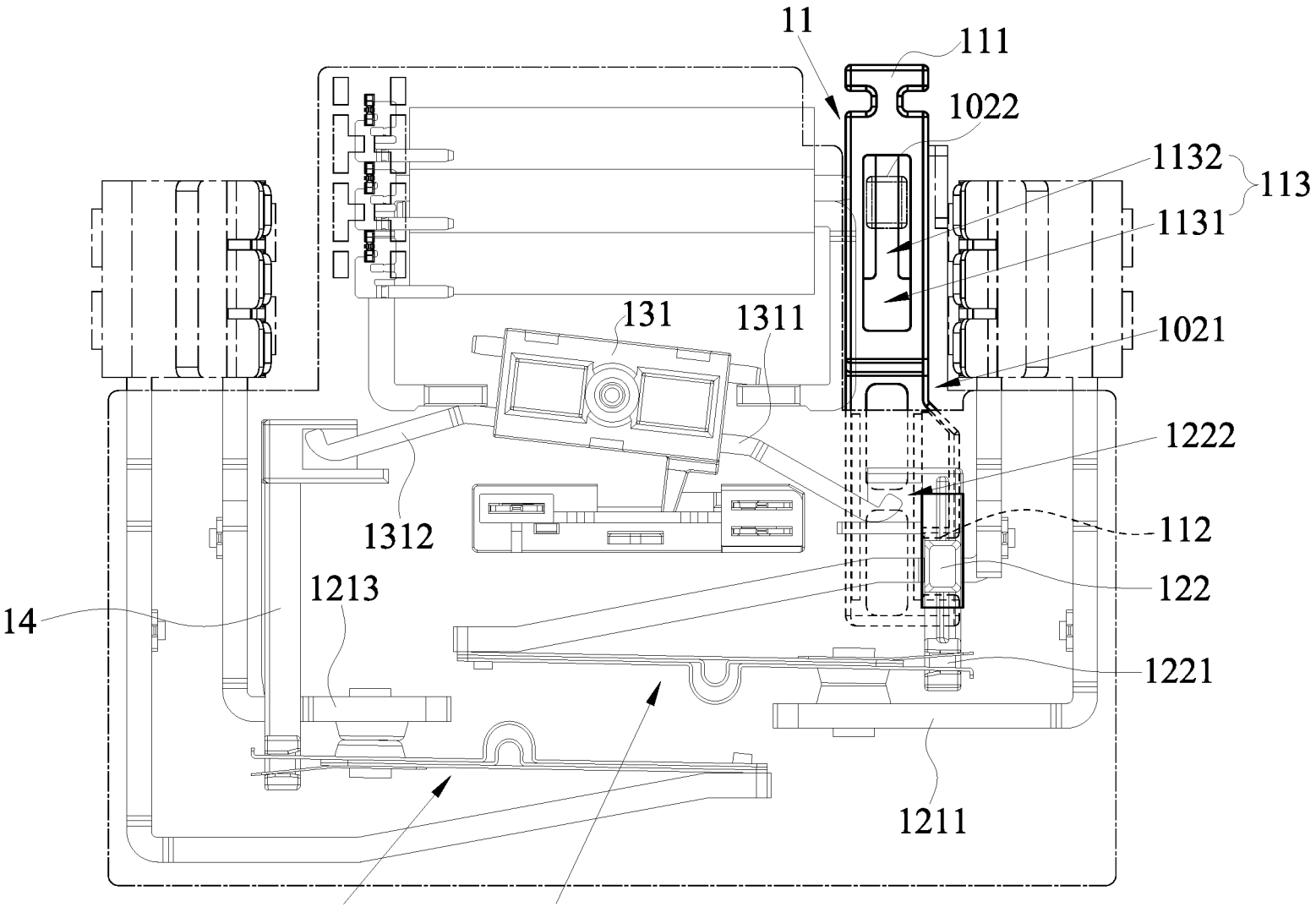
FIG. 3 is a first schematic view of an electromagnetic relay in accordance with an embodiment of the present invention.
Figure 4:
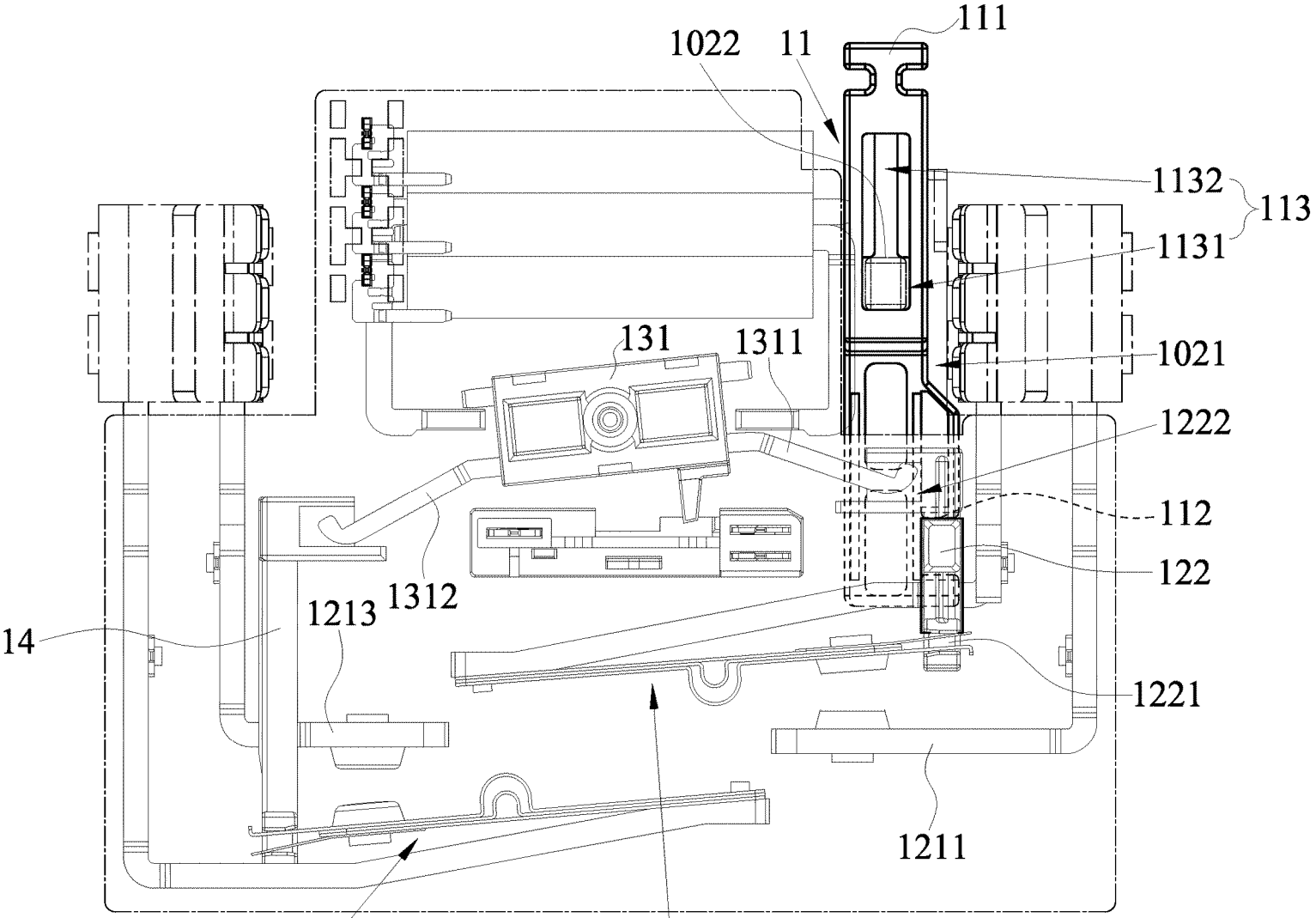
FIG. 4 is a second schematic view of an electromagnetic relay in accordance with an embodiment of the present invention.

In an application as shown in FIGS. 3 and 4, some of the components are omitted in FIGS. 3 and 4 for simplicity, and FIG. 3 shows the conductive state of the electromagnetic relay 1 and FIG. 4 shows a non-conductive state of the electromagnetic relay 1. The hook portion 112 of the push-pull rod 11 and the lever 122 are engaged securely with each other. In a preferred embodiment, when it is necessary to adjust the electrical state of the electromagnetic relay 1, the force applying portion 111 of the push-pull rod 11 is pulled outwardly to move the sliding hole 1132 relative to the bump 1022, and the hook portion 112 will be displaced in the casing 10 to drive the lever 122 to move upward, while the second engaging slot 1222 of the lever 122 drives the first rotating plate 1311 to move upward, and rotate the rotating bridge 13. Now, the first movable contact plate 1212 is driven by the first engaging slot 1221 which is coupled to the first movable contact plate 1212 to separate from the first fixed contact plate 1211. In response to the second rotating plate 1312 of the rotating bridge 13, the second movable contact plate 1214 is synchronously disconnected from the second fixed contact plate 1213, so that the electromagnetic relay 1 forms a non-conductive state, and the electrical state of the electromagnetic relay 1 can be switched from the state as shown in FIG. 3 to the state as shown in FIG. 4. On the other hand, when it is necessary to change the state of the electromagnetic relay 1 to the conductive state, the push-pull rod 11 is pushed to move the sliding hole 1132 relative to the bump 1022, so that the hook portion 112 moves the lever 122 downward. Now, the second engaging slot 1222 of the lever 122 drives the first rotating plate 1311 to move downward and rotate the rotating bridge 13, and the first movable contact plate 1212 is in contact with the first fixed contact plate 1211 in response to the connected first engaging slot 1221. In response to the second rotating plate 1312 of the rotating bridge 13, the second movable contact plate 1214 is contacted with the second fixed contact plate 1213 synchronously, so that the electromagnetic relay 1 forms a conductive state, which is a state switched from the state as shown in FIG. 4 to the state as shown in FIG. 3.

In summation of the description above, the electromagnetic relay capable of externally and manually controlling, turning on and shutting off the electric power 1 in accordance with the present invention is surely a novel product that can meet various application requirements. With the push-pull rod 11 installed to the outer side of the electromagnetic relay 1 and the configuration of the slideway 1021 on the casing 10 and the lever 122 of the relay module 12, the effect of externally and directly controlling, turning on and shutting off the electric power can be achieved to improve the convenience of application significantly. Besides the novel structural design of the electromagnetic relay of the present invention, the structures of the push-pull rod 11, the slideway 1021 and the lever 122 are designed according to various considerations, and the structural design of the elastic contact plate assembly capable of controlling the interior from the exterior in the limited space of the electromagnetic relay. To further facilitate the push-pull control, the present invention also provides detailed structural characteristics for the fitting hole 1131 and the push-pull rod 11. To recognize the ON/OFF state of the relay quickly, the visual opening 1023 is added to the top cover 102. These technical characteristics of the present invention further improve over the prior art.

What is claimed is:

1. An electromagnetic relay capable of externally and manually controlling, turning on, and shutting off electric power, comprising:

a casing, having a chassis and a top cover, wherein a slideway is concavely formed on the top cover, and an end of the slideway is communicated with an inner side of the top cover, and the other end of the slideway has a bump, and the cross-section of the bump is T-shaped;

a push-pull rod, installed to the slideway and movable relative to the top cover, and having an end formed into a force applying portion and the other end formed into a hook portion and passed into the casing, and an open slot being concavely formed on the push-pull rod, and a fitting hole and a sliding hole being formed at the bottom of the open slot and coupled to each other, and the sliding hole being in a regular rectangular shape, and the fitting hole having a size corresponding to the size of the bump, and the sliding hole having a width smaller than that of the fitting hole; and a relay module, installed in the chassis, and having at least one elastic contact plate assembly and a lever facing the top cover, and the elastic contact plate assembly having at least one fixed contact plate and at least one movable contact plate, and the lever having an end directly or indirectly pushing the movable contact plate and the fixed contact plate to be contacted with or disconnected from each other and the other end engaged securely with the hook portion; wherein after the fitting hole of the push-pull rod is sheathed on the bump, the sliding hole can be moved relative to the bump to drive the hook portion to displace in the casing, and after a force is exerted onto the force applying portion, the sliding hole can be moved relative to the position of the bump, so that the hook portion drives the lever to push the elastic contact plate assembly to form an electrical connection or disconnection state.

2. The electromagnetic relay as claimed in claim 1, further comprising: a rotating bridge, having a main body, and a first rotating plate and a second rotating plate extending from both sides of the main body respectively; wherein if both of the quantity of the fixed contact plates and the quantity the movable contact plates are two, they are defined as a first fixed contact plate and a first movable contact plate, and a second fixed contact plate and a second movable contact plate; an end of the lever has a first engaging slot and a second engaging slot, and the first engaging slot and the first movable contact plate are engaged and coupled to each other securely, and the second engaging slot and the first rotating plate are engaged and coupled to each other securely, and the second rotating plate is directly or indirectly engaged and coupled to the second movable contact plate; after a force is exerted onto the lever, the electrical connection or disconnection state of the first movable contact plate with the first fixed contact plate and the electrical connection or disconnection state of the second movable contact plate with the second fixed contact plate can be achieved synchronously.

3. The electromagnetic relay as claimed in claim 2, wherein the second rotating plate of the rotating bridge is engaged securely to an end of an extension arm, and the other end of the extension arm is engaged securely to the second movable contact plate.

4. The electromagnetic relay as claimed in claim 3, wherein the main body of the rotating bridge has a magnetic property.

5. The electromagnetic relay as claimed in claim 1, wherein the fitting hole is either in a circular shape or in a square shape.

6. The electromagnetic relay as claimed in claim 5, further comprising: a rotating bridge, having a main body, and a first rotating plate and a second rotating plate extending from both sides of the main body respectively; wherein if both of the quantity of the fixed contact plates and the quantity the movable contact plates are two, they are defined as a first fixed contact plate and a first movable contact plate, and a second fixed contact plate and a second movable contact plate; an end of the lever has a first engaging slot and a second engaging slot, and the first engaging slot and the first movable contact plate are engaged and coupled to each other securely, and the second engaging slot and the first rotating plate are engaged and coupled to each other securely, and the second rotating plate is directly or indirectly engaged and coupled to the second movable contact plate; after a force is exerted onto the lever, the electrical connection or disconnection state of the first movable contact plate with the first fixed contact plate and the electrical connection or disconnection state of the second movable contact plate with the second fixed contact plate can be achieved synchronously.

7. The electromagnetic relay as claimed in claim 6, wherein the second rotating plate of the rotating bridge is engaged securely to an end of an extension arm, and the other end of the extension arm is engaged securely to the second movable contact plate.

8. The electromagnetic relay as claimed in claim 7, wherein the main body of the rotating bridge has a magnetic property.

9. The electromagnetic relay as claimed in claim 5, wherein the force applying portion is a T-shaped workpiece.

10. The electromagnetic relay as claimed in claim 9, further comprising: a rotating bridge, having a main body, and a first rotating plate and a second rotating plate extending from both sides of the main body respectively; wherein if both of the quantity of the fixed contact plates and the quantity the movable contact plates are two, they are defined as a first fixed contact plate and a first movable contact plate, and a second fixed contact plate and a second movable contact plate; an end of the lever has a first engaging slot and a second engaging slot, and the first engaging slot and the first movable contact plate are engaged and coupled to each other securely, and the second engaging slot and the first rotating plate are engaged and coupled to each other securely, and the second rotating plate is directly or indirectly engaged and coupled to the second movable contact plate; after a force is exerted onto the lever, the electrical connection or disconnection state of the first movable contact plate with the first fixed contact plate and the electrical connection or disconnection state of the second movable contact plate with the second fixed contact plate can be achieved synchronously.

11. The electromagnetic relay as claimed in claim 10, wherein the second rotating plate of the rotating bridge is engaged securely to an end of an extension arm, and the other end of the extension arm is engaged securely to the second movable contact plate.

12. The electromagnetic relay as claimed in claim 11, wherein the main body of the rotating bridge has a magnetic property.

13. The electromagnetic relay as claimed in claim 9, wherein the push-pull rod has a plurality of through-hole portions.

14. The electromagnetic relay as claimed in claim 13, further comprising: a rotating bridge, having a main body, and a first rotating plate and a second rotating plate extending from both sides of the main body respectively; wherein if both of the quantity of the fixed contact plates and the quantity the movable contact plates are two, they are defined as a first fixed contact plate and a first movable contact plate, and a second fixed contact plate and a second movable contact plate; an end of the lever has a first engaging slot and a second engaging slot, and the first engaging slot and the first movable contact plate are engaged and coupled to each other securely, and the second engaging slot and the first rotating plate are engaged and coupled to each other securely, and the second rotating plate is directly or indirectly engaged and coupled to the second movable contact plate; after a force is exerted onto the lever, the electrical connection or disconnection state of the first movable contact plate with the first fixed contact plate and the electrical connection or disconnection state of the second movable contact plate with the second fixed contact plate can be achieved synchronously.

15. The electromagnetic relay as claimed in claim 14, wherein the second rotating plate of the rotating bridge is engaged securely to an end of an extension arm, and the other end of the extension arm is engaged securely to the second movable contact plate.

16. The electromagnetic relay as claimed in claim 15, wherein the main body of the rotating bridge has a magnetic property.

17. The electromagnetic relay as claimed in claim 13, wherein the top cover has a visual opening formed thereon, configured to be corresponsive to a moving position of the lever, and provided for visually determining the electrical connection or disconnection state of the elastic contact plate assembly.

18. The electromagnetic relay as claimed in claim 17, further comprising: a rotating bridge, having a main body, and a first rotating plate and a second rotating plate extending from both sides of the main body respectively; wherein if both of the quantity of the fixed contact plates and the quantity the movable contact plates are two, they are defined as a first fixed contact plate and a first movable contact plate, and a second fixed contact plate and a second movable contact plate; an end of the lever has a first engaging slot and a second engaging slot, and the first engaging slot and the first movable contact plate are engaged and coupled to each other securely, and the second engaging slot and the first rotating plate are engaged and coupled to each other securely, and the second rotating plate is directly or indirectly engaged and coupled to the second movable contact plate; after a force is exerted onto the lever, the electrical connection or disconnection state of the first movable contact plate with the first fixed contact plate and the electrical connection or disconnection state of the second movable contact plate with the second fixed contact plate can be achieved synchronously.

19. The electromagnetic relay as claimed in claim 18, wherein the second rotating plate of the rotating bridge is engaged securely to an end of an extension arm, and the other end of the extension arm is engaged securely to the second movable contact plate.

20. The electromagnetic relay as claimed in claim 19, wherein the main body of the rotating bridge has a magnetic property.

* * * * *